United States Patent [19]

Denison

[11] Patent Number: 4,958,581

[45] Date of Patent: Sep. 25, 1990

[54] SAILBOARD APPARATUS

[76] Inventor: Ian Denison, 1210 West King Edward Ave., Vancouver, British Columbia, Canada, V6H 1Z7

[21] Appl. No.: 303,475

[22] Filed: Jan. 27, 1989

[51] Int. Cl.[5] ..... B63H 9/10

[52] U.S. Cl. ..... 114/93; 114/90; 114/39.2

[58] Field of Search ..... 114/89, 90, 91, 93, 114/97, 39.1, 39.2; 73/188

[56] References Cited

U.S. PATENT DOCUMENTS 3,157,148 11/1964 Reed ..... 114/90

4,718,369 1/1988 Pollard ..... 114/90

*Primary Examiner*—Joseph F. Peters, Jr.

*Assistant Examiner*—Edwin L. Swinehart

*Attorney, Agent, or Firm*—Christie, Parker & Hale

[57] ABSTRACT

A sailboard has a force responsive device connected to its mast for providing first and second output signals corresponding to the shearing forces acting between the mast and the sailboard in the longitudinal direction of the sailboard and in the transverse direction of the sailboard, with an indicator responsive to the first and second output signals for providing visual indications representing the shearing forces to enable improved operation of the sailboard.

4 Claims, 2 Drawing Sheets

SAILBOARD APPARATUS

FIELD OF THE INVENTION

The present invention relates to sailboards and, more particularly, to sailboards having masts connected to the boards by joints which allow universal pivotation of the masts relative to their sailboards.

BACKGROUND OF THE INVENTION

A conventional sailboard is controlled by standing on the sailboard and manipulating a boom, attached to the mast and the sail, so as to control the direction of travel of the sailboard and other aerodynamic and hydrodynamic variables affecting the sailboard.

It has previously been proposed, in the case of a conventional sailboard, to provide a strain gauge on the mast so as to detect the magnitude of the forward component of the strain imposed on the mast by its sail. Such an arrangement is disclosed in U.S. Pat. No. 3,157,148, issued to J.H. Reed on Sept. 25, 1961.

However, the factors affecting the operation of a sailboard are different, in a number of respects, from those effecting operation of a sailboard.

Thus, a sailboard has a mast which is fixedly secured at its lower end or foot to the hull of the sailboard.

A sailboard, on the other hand, has a mast which is connected to the sailboard through a universal joint. Consequently, and in contrast to a sailboard, the mast of a sailboard is capable of rotating through 360 degrees, and the mast and sail of the sailboard can be inclined into the wind in order to produce a lifting component from the wind to reduce the water drag.

BRIEF SUMMARY OF THE INVENTION

It is an object from the present invention to provide, in a sailboard, a novel and advantageous arrangement for providing the user of the sailboard with measurement data to facilitate and improve his control of the sailboard.

It is a further object of the present invention to provide a sailboard with means for measuring and indicating to the user of a sailboard the longitudinal and transverse shearing forces acting between the board and its mast.

It is still a further object of the present invention to provide means in a sailboard for acquiring and indicating to the user of the sailboard aerodynamic and hydrodynamic feedback data relating to the performance of the sail and of the board.

According to the present invention, there is provided, in a sailboard provided with a mast, the improvement comprising force responsive means connected to the mast and to the sailboard for providing first and second output signals corresponding to the shearing forces acting between the mast and the sailboard in the longitudinal direction of the sailboard and in the transverse direction of the sailboard, respectively, and indicator means responsive to the first and second outward signals for providing indications representing these shearing forces.

The force responsive means connect the mast to the sailboard and, more particularly, are provided between the sailboard and the universal joint, to which the mast is secured. The force responsive means comprises a pair of strain gauges arranged at right angles to one another for measuring the shearing forces in the longitudinal and transverse directions, respectively.

The indicator means may be selectively adjustable for displaying either of the first and second output signals, or the ratio of the first and second output signal, and is conveniently provided in the form of a visual indicator mounted on the boom of the rig of the sailboard.

BRIEF DESCRIPTION OF THE DRAWINGS

Further features, advantages and objects of the invention will become more readily apparent from the following detailed description of an embodiment thereof taken in conjunction with the accompanying drawings, in which.

DESCRIPTION OF THE PREFERRED EMBODIMENT

Figure 1:
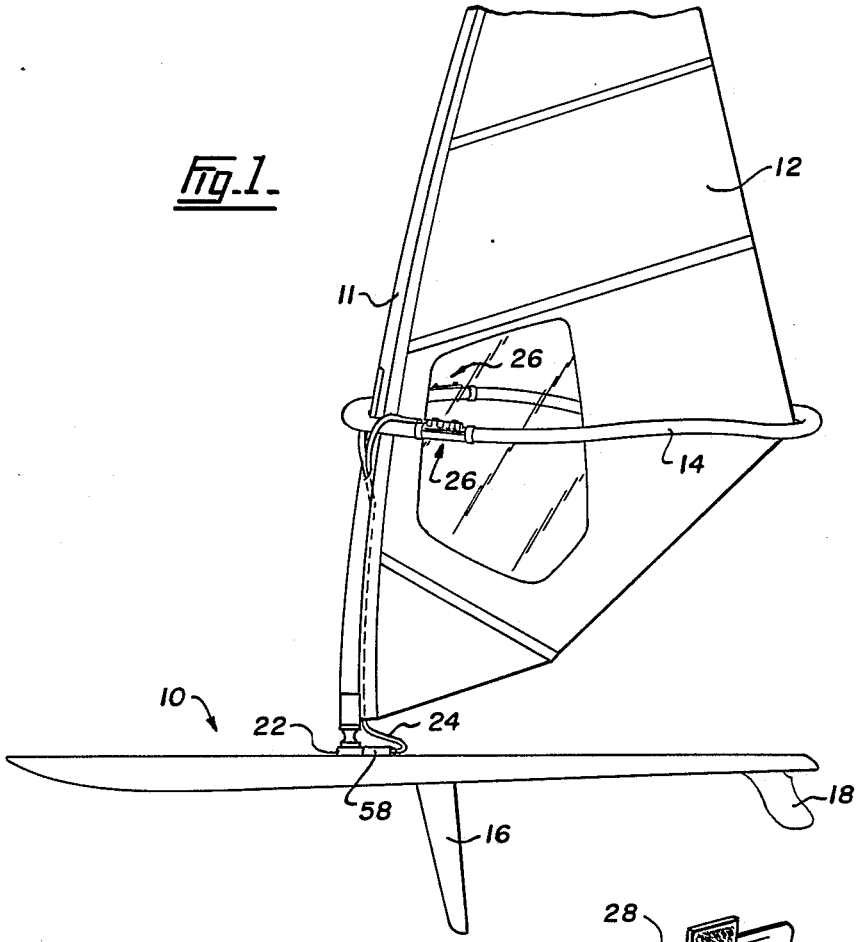
FIG. 1 shows a broken-away view, inside elevation, of a sailboard embodying the present invention.

Referring now to the accompanying drawings in greater detail, there is shown in FIG. 1 a sailboard which is indicated generally by reference numeral 10 and which is provided with a mast 11, with a sail 12 attached to the mast 11 and to a boom 14.

The sailboard 10 is provided with a keel 16, and with a skeg 18. However, it is to be understood that the keel 16 and the skeg 18 are not essential to the invention and may therefore be omitted, if desired.

The foot of the mast 11 is connected to a conventional universal joint 20 of resilient material, which in turn is mounted on the top of a force measuring device or sensor 22.

The force measuring device 22 is anchored in the top of the sailboard 10 and serves to connect the sailboard 10 to the universal joint 20 and, thus, to the mast 11.

The force measuring device 22 comprises a pair of strain gauges or X and Y force sensors **39*a*39*b* (FIG. 4), which respectively measure the shearing forces between the. sailboard 10 and the mast 11 in the longitudinal direction and in the transverse direction of the sailboard 10**.

Such force measuring devices are commercially available and one suitable device which may be used for this purpose is the Lebow X-Y Force Sensor, sold by Eaton Corporation.

The force measuring device 22 is-connected by a cable 24 to a pair of indicators 26, which are mounted on respective arms of the boom. Having regard to the environment in which the sailboard is normally used, this cable 24 and its connections to the force measuring device 22 and the indicators 26 are provided with suitable water-proof and corrosion-resistant coverings and connectors.

Figure 2:
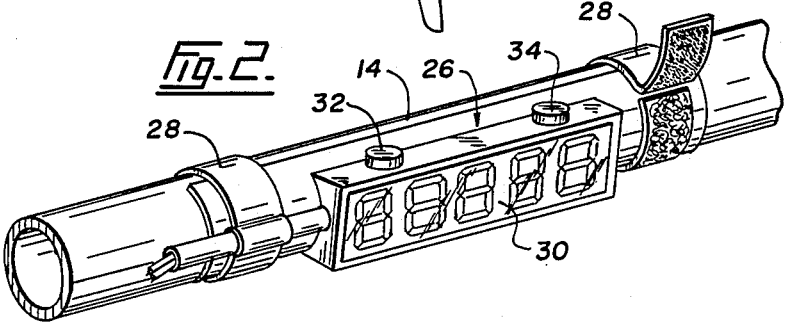
FIG. 2 shows a broken-away view, in perspective, of feedback data indicator mounted on the boom of the sailboard of FIG. 1.
Figure 3:
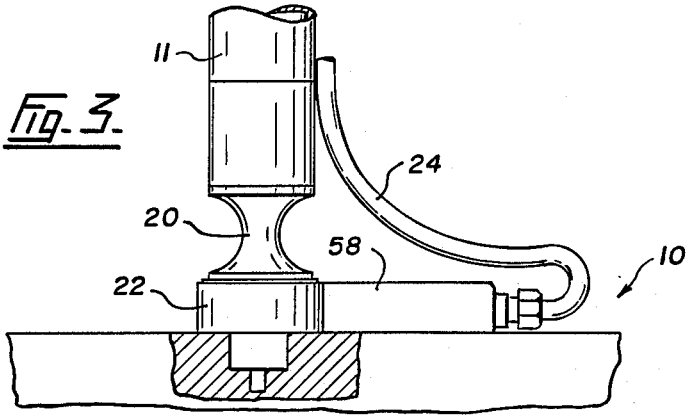
FIG. 3 shows a view, partially broken-away in cross-section, of the connection between the foot of the mast of the sailboard of FIG. 1 and the sailboard itself.

One of the indicators 26 is shown in greater detail in FIG. 2, from which it can be seen that the indicator 26 has an elongate housing shaped to fit snugly against the cylindrical cross-section of the arm 14 and secured to such arm by securement bands or straps 28.

The indicator 26 has a digital display face 30 and a pair of actuating knobs 32 and 34.

Figure 4:
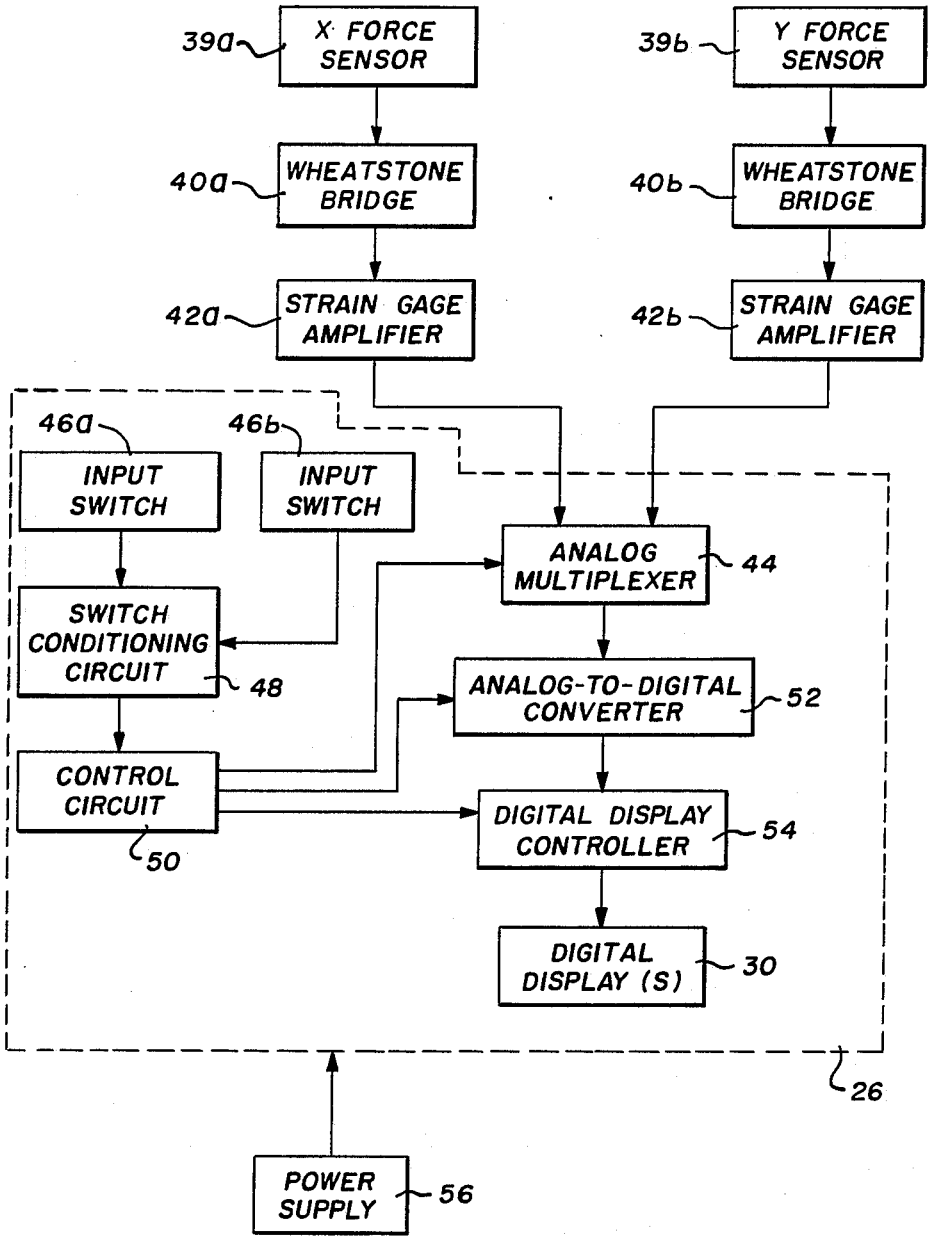
FIG. 4 shows a block diagram of the electrical components of the feedback data indicator of FIG. 2.

As shown in FIG. 4, the outputs of the X and Y force sensors 39a and 39b are connected through Wheatstone bridge circuits 40a and 40b and amplifiers 42a and 42b to an analog multiplexer 44.

The activating knobs 32 and 34 serve to activate input switches 46a and 46b, the outputs of which are connected through switch conditioning circuit 48 to a control circuit 50.

The switch conditioning circuit 48 is provided for conditioning square wave pulses from the input switches 46a and 46b and the control circuit 50, in response to these pulses controls the analog multiplexer 44 and also our analog-to-digital connector 52 and a digital display controller 54, which are connected to the output of the analog multiplexer.

The digital display 30 is connected to the output of the digital display controller 54, and a power supply 56 in the form of a battery pack is connected to energize the above-described electrical components, which are accommodated in a watertight housing 58 on the sailboard at the foot of the mast.

In operation of the sailboard, the force measurement device 22 provides first and second output signals corresponding, respectively, to the shearing forces in the longitudinal direction and in the transverse direction and acting between the mast 11 and the sailboard 10. The first and second output or feedback signals are supplied from the X and Y sensors 39a and 39b, via the Wheatstone bridge circuits 40a and 40b and through the cable 24 to the indicators 26.

By manipulation of the control knobs 32 and 34, which may comprise push buttons, the indicator devices 26 can be caused to provide a visual indication of either the first output signal or the second output signal or the ratio between the first and second output signals.

The data thus acquired and presented to the user of the sailboard can be used in various different manners to improve the rigging and/or the operation of the sailboard.

Thus, referring firstly to the aerodynamic factors affecting the operation of the sailboard, and as will be readily appreciated by those skilled in the art and by experienced users of sailboards, the rig of a sailboard is designed to create lift, except when running with the wind, in a direction at ninety degrees to the cord of the rig. This lift can be broken down into longitudinal and transverse components. A longitudinal component provides motive force in the longitudinal direction of the board, and the transverse component produces drift. These force components correspond to the shearing forces which are measured and displayed as indicated above, which allows the user of the board to optimize the position of the sail for any particular heading of the sailboard. Also, as in the case of the wing of an airplane, a high camber sail produces more lift in low wind and a low camber sail produces more lift in high wind. By utilizing the display information provided by the indicators 26, the sail camber can be adjusted for optimal shape, either with the sailboard beached or while sailing.

A regular sailboard can, of course, be tilted fore and aft to produce downwind and upwind turns, respectively. The present arrangement provides the user with instantaneous feedback relating to the turning tendency of the sailboard, the feedback being in the form of a change in the magnitude of the transverse force component. This is useful in assisting the user to maintain a straight course or to know when to execute a tack or a gibe.

Furthermore the present arrangement assists the user in selecting which of the variety of available sail shapes and structures to use, (e.g. rotational asymmetrical foil, camber induced, fully battened, low leech, high leech, powerhead, etc.), while still on dry land by registering the shearing force transmitted through the device in the prevailing wind conditions.

With respect to the hydrodynamic variables affecting the sailboard operation, a conventional sailboard hull has an underwater shape which varies from bow to stern. Thus, in low wind a sailboard displaces water, and the front or forward motion of the sailboard hull is designed to effect this in an efficient manner. In high wind, on the other hand, the sailboard hydroplanes, i.e. lifts partially from the water, and the aft $\frac{1}{3}$ of the board hull is designed to produce the least drag at hydroplane speed.

In intermediate conditions, however, the sailboard sailor can utilize either the front or the rear of the board, or the rear alone, by moving his mast track forwards or backwards and by moving his feet forwards and backwards, in an effort to minimize the drag created by the board.

The present invention provides the sailor with instantaneous data as to what specific body and sail rig position produce minimum drag.

A sailboard is turned by two basic methods. According to one method, the rig is inclined forwardly or backwardly to produce a turning movement about a daggerboard or keel.

The other method is effective only when the board is hydroplaning and requires the board to be ti)ted about its longitudinal axis so as to increase drag on one side and, thereby, to turn the board in the water.

The daggerboard prevents excessive sideways drift but produces drag which is squared as the speed of travel of the sailboard through the water doubles.

There is a critical phase at which the user of the board has to decide when to retract the daggerboard to provide a cleaner shape to the water. The ability of a sailboard embodying the present invention to measure drag and lateral forces at the mast-sailboard interface provides data which allows the user to retract the daggerboard at the precise instant when it becomes more efficient to do so.

The longitudinal stability of a sailboard is provided by the action of the skeg in the water, and this is the fin near the stern. The skeg may also be provided with a pre-skeg or a pair of thrusters which help to reduce cavitation and improve the grip of the skeg on the water. These additional components do, however, increase parasitic drag and in instances are counterproductive achieving the desired goal of maximum speed in a given direction.

However, the present invention enables the user to obtain information indicating whether these components should or should not be used for the prevailing conditions and also can be used to measure the performance of various shapes and types of skeg, which the user is able to change very quickly. Since various modifications may be made in the above-described embodiment of the present invention, the scope of the invention is not restricted to such embodiment but may be varied within the scope of the accompanying claims.

I claim:

1. In a sailboard provided with a mast the improvement comprising;

force responsive means connected to said mast and said sailboard for providing first and second output signals corresponding to the shearing forces acting between said mast and said sailboard in the longitudinal direction of said sailboard and in the transverse direction of said sailboard, respectively;

indicator means responsive to said first and second output signals for providing indications representing said shearing forces;

said force responsive means comprising means connecting said mast to said sailboard;

means for forming a universal joint between said mast and said sailboard; and means connecting said mast to said universal joint;

said force responsive means comprising means connecting said universal joint to said sailboard.

2. A sailboard as claimed in claim 1, wherein said force responsive means comprise a pair of strain gauges adapted to be arranged at right angles to one another for measuring said shearing forces in said longitudinal and transverse directions, respectively.

3. A sailboard as claimed in claim 1, wherein said indicator means comprise means for selectively displaying an indicator either of said first and second output signals.

4. A sailboard as claimed in claim 1, wherein said indicator means comprise means for displaying the ratio of said first and second output signals.

* * * * *

UNITED STATES PATENT AND TRADEMARK OFFICE

CERTIFICATE OF CORRECTION

PATENT NO. : 4,958,581

DATED : September 25, 1990

INVENTOR(S) : Ian Denison

It is certified that error appears in the above-identified patent and that said Letters Patent is hereby corrected as shown below:

Column 2, line 45, between "39a" and "39b" insert a comma.

Column 2, line 48, after "the" and before "sailboard" delete the period.

Column 2, line 54, between "is" and "connected" delete the hyphen.

Column 4, line 34, after "be" change "ti)ted" to -- tilted --.

Signed and Sealed this

Twenty-first Day of April, 1992

*Attest:*

HARRY F. MANBECK, JR.

*Attesting Officer*

*Commissioner of Patents and Trademarks*